US007583028B2

(12) United States Patent
Takagaki et al.

(10) Patent No.: US 7,583,028 B2
(45) Date of Patent: Sep. 1, 2009

(54) MERCURY FREE ARC TUBE FOR A DISCHARGE LAMP

(75) Inventors: Michio Takagaki, Shizuoka (JP); Takeshi Fukuyo, Shizuoka (JP); Shinichi Irisawa, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 625 days.

(21) Appl. No.: 11/012,287

(22) Filed: Dec. 16, 2004

(65) Prior Publication Data

US 2005/0156529 A1 Jul. 21, 2005

(30) Foreign Application Priority Data

Dec. 22, 2003 (JP) ..... P. 2003-424014

(51) Int. Cl.
*H01J 61/12* (2006.01)
*H01J 17/20* (2006.01)

(52) U.S. Cl. ..... 313/637; 313/638; 313/643

(58) Field of Classification Search ..... None
See application file for complete search history.

(56) References Cited

U.S. PATENT DOCUMENTS

| | | | | |
|---|---|---|---|---|
| 6,265,827 | B1 * | 7/2001 | Takahashi et al. | 313/638 |
| 6,670,765 | B2 * | 12/2003 | Muto | 315/82 |
| 7,126,281 | B2 * | 10/2006 | Grundmann et al. | 313/637 |
| 2002/0017848 | A1 * | 2/2002 | Minamihata et al. | 313/161 |
| 2003/0052610 | A1 * | 3/2003 | Takagaki et al. | 313/637 |
| 2003/0057876 | A1 | 3/2003 | Muto | |
| 2004/0150343 | A1 * | 8/2004 | Takahashi et al. | 313/623 |

FOREIGN PATENT DOCUMENTS

| | | | |
|---|---|---|---|
| DE | 102 43 867 | A1 | 5/2003 |
| DE | 103 12 290 | A1 | 9/2004 |
| EP | 1 037 257 | A2 | 9/2000 |
| EP | 1 037 258 | A1 | 9/2000 |
| EP | 1 063 681 | A2 | 12/2000 |
| EP | 1 172 840 | A2 | 1/2002 |
| EP | 1172840 | A2 * | 1/2002 |
| EP | 1 349 197 | A2 | 10/2003 |
| JP | 11-86795 | A | 3/1999 |
| JP | 11-307048 | A | 11/1999 |
| JP | 2004-172056 | A | 6/2004 |

* cited by examiner

*Primary Examiner*—Sikha Roy
(74) *Attorney, Agent, or Firm*—Sughrue Mion PLLC

(57) ABSTRACT

A mercury free arc tube for a discharge lamp has a closed chamber filled with rare gas and a metal halide containing at least Na halide, Sc halide and In halide, and electrodes. A ratio of a filled amount of the In halide to a total filled amount of metal halide is ranging from 0.1 to 2.0 wt %. When the ratio of the charging amount of InI is 0.1 wt % or more, the chromaticity x, y of a luminescent color during a stable discharge falls within a chromaticity standard range A of white light source. When the ratio of charging amount of InI is 2.0 wt % or less, a chromaticity y minimal value of luminescence of the arc tube at the transient time is 0.29 or more, whereby purplish red color is less conspicuous and there is no fear that an emission of the arc tube is misidentified a red marker lamp.

9 Claims, 7 Drawing Sheets

FIG. 3A

| IMPERMISSIBLE | | PERMISSIBLE | | NO SENSE OF INCOMPATIBILITY | |
|---|---|---|---|---|---|
| CHROMATICITY x | CHROMATICITY y MIN | PERMISSIBLE | CHROMATICITY y MIN | CHROMATICIRY x | CHROMATICITY y MIN |
| 0.311 | 0.276 | 0.320 | 0.292 | 0.330 | 0.322 |
| 0.309 | 0.278 | 0.321 | 0.295 | 0.325 | 0.324 |
| 0.313 | 0.282 | 0.315 | 0.297 | 0.331 | 0.331 |
| 0.317 | 0.285 | 0.323 | 0.300 | 0.330 | 0.333 |
| 0.298 | 0.273 | 0296 | 0.301 | 0.337 | 0.339 |
| 0.299 | 0.267 | 0.302 | 0.302 | 0.340 | 0.336 |
| 0.300 | 0.266 | 0.313 | 0.307 | | |
| 0.314 | 0.286 | 0.325 | 0.313 | | |
| 0.310 | 0.288 | 0.318 | 0.315 | | |
| 0.311 | 0.289 | 0.315 | 0.318 | | |

| Inl RATIO | CHROMATICITY x | CHROMATICITY y | EVALUATION |
|---|---|---|---|
| 0.0 | 0.383 | 0.396 | X |
| 0.1 | 0.383 | 0.394 | O |
| 0.5 | 0.383 | 0.393 | O |
| 1.0 | 0.383 | 0.392 | O |
| 1.5 | 0.383 | 0.391 | O |
| 1.8 | 0.382 | 0.391 | O |
| 2.2 | 0.382 | 0.389 | O |
| 2.9 | 0.380 | 0.388 | O |

MERCURY FREE ARC TUBE FOR A DISCHARGE LAMP

The present invention claims foreign priority to Japanese patent application No. P.2003-424014, filed on Dec. 22, 2004, the contents of which is incorporated herein by reference.

BACKGROUND OF THE INVENTION

1. Field of the Invention

The present invention relates to an arc tube for a discharge lamp, having a closed chamber filled with rare gas and a metal halide containing at least Na halide, Sc halide and In halide, an internal volume of the closed chamber being 50 μl or less, and electrodes provided so as to be opposed to each other.

2. Description of the Related Art

FIG. 8 shows a conventional discharge lamp. The discharge lamp has such a structure that a front end portion of a quartz-glass arc tube 5 is supported with one lead support 2 protruded forward from an insulating base 1, a rear end portion of the arc tube 5 is supported with a concave portion 1*a* of the base 1, and the arc tube 5 is sustained at a portion near its rear end with a metal supporting member 4 fixed to a front surface of the insulating base 1. A front end-side lead wire 8 led from the arc tube 5 is fixed to the lead support 2 by the welding, while a rear end-side lead wire 8 is passed through a bottom wall 1*b* constituting the concave portion 1*a* of the base 1 and secured to a terminal 3 provided to the bottom wall 1*b* by the welding. A symbol G is a cylindrical ultraviolet shielding globe made of the glass to cut off an ultraviolet component in a bandwidth that is harmful to a human body from the light that is emitted from the arc tube 5. This ultraviolet shielding globe G is deposited integrally to the arc tube 5.

Then, the arc tube 5 has such a structure that a closed glass globe 5*a* in which electrodes 6, 6 are provided between a pair of front and rear pinch sealed portions 5*b*, 5*b* to oppose to each other and into which luminous substances i.e., Na halides, Sc halides or Hg, are sealed together with a starting rare gas is formed. A molybdenum foil 7 for connecting the electrode 6 protruded into the closed glass globe 5*a* and the lead wire 8 led from the pinch sealed portion 5*b* is sealed in the pinch sealed portion 5*b*, and thus an air tightness in the pinch sealed portion 5*b* is maintained.

In this case, this Hg sealed in the closed glass globe 5*a* is a very useful buffer substance to relieve the damage of the electrode by maintaining a predetermined tube voltage and reducing an amount of collision of the electron to the electrode 6. However, such Hg is an environmentally hazardous material. For this reason, recently the development of the so-called mercury-free arc tube into which Hg acting as the environmentally hazardous material is not sealed is accelerated.

It has been proposed in Japanese Patent Unexamined Publications No. JP-A-11-86795 paragraph 0026 and No. JP-A-11-307048 paragraphs 0031 through 0034 that In halide is charged, instead of Hg, in order to maintain a tube voltage.

That is, in JP-A-11-86795, In halide, instead of Hg, is charged by 1 to 100 μmol/cm$^3$ as a voltage gradient formation medium. In JP-A-11-307048, InI is charged in addition to $ScI_3$ and NaI as metal halides, whereby a decrease in the voltage due to mercury free is improved, and a luminescent color, which is within a chromaticity standard range required as a white light source, is obtained.

However, in a development process of a mercury free arc tube, when the inventor charges an amount of InI as disclosed in the JP-A-11-86795 and JP-A-11-307048 into the closed glass globe, the arc tube emits in purplish red color at the early time of starting the discharge. Accordingly, there is a possibility that the emission of the arc tube is misidentified or confused with lighting of a red marker lamp such as a tail lamp or a stop lamp, resulting in an unpreferable problem.

Thus, to confirm this cause, the inventor made an experiment for investigating changes in the luminescent color (chromaticity characteristic curve) of the arc tube at the transient time after starting the discharge till reaching the stable discharge, employing each sample of the mercury free arc tube having a different ratio (wt %) of the charging amount of InI to the amount of metal halides ($ScI_3$, NaI, and InI, etc.) charged together with Xe gas into the closed glass globe.

FIGS. 2A, 2B and 2C are graphs when the ratio (wt %) of the charging amount of InI to the total charging amount of metal halides is 0.1%, 1.0% and 2.9%. In any instances, the graph decreases left obliquely downwards to reach the chromaticity minimal value Pmin, and then rises right obliquely upwards to reach a stable position Pa at which the values of chromaticity x, y are within the chromaticity standard ECE R99 of the white light source during the stable discharge ($x \geqq 0.345$ $y \leqq 0.150+0.640x$, $x \leqq 0.405$ $y \geqq 0.050+0.750x$ (hereinafter referred to as "ECE R99", its range is indicated by symbol A in FIG. 6) with the elapse of time. That is, as the temperature of the arc tube rises, the luminescent color of the arc tube is firstly white that is luminescent color of Xe, then blue that is luminescent color of In and Sc, and finally red that is luminescent color of Na, whereafter the arc tube transfers to a white stable discharge state in which all the luminous substances emit.

Therefore, when an amount of InI is charged as disclosed in the JP-A-11-86795 and JP-A-11-307048, the ratio (wt %) of the charging amount of InI to the total charging amount of metal halides is too large, so that the luminescent color at the transient time up to reaching the stable discharge is strongly purplish red with the low values of chromaticity x and y, whereby there is a fear that the emission of the arc tube is misidentified for or confused with lighting of the red marker lamp.

Thus, the inventor made a visible evaluation test of the chromaticity minimal value Pmin at the transient time, that is for evaluating whether or not the purplish red color is conspicuous by inspecting the luminescence of the arc tube with the naked eye, for each samples (arc tubes) having a different ratio (wt %) of the charging amount of InI to the total charging amount of metal halides of $ScI_3$, NaI and InI. The evaluation result was that the purplish red color is conspicuous when the chromaticity y minimal value is less than 0.29, but is not so conspicuous in a range where the chromaticity y minimal value is from 0.29 to 0.32, and not conspicuous at all, in other words, with no sense of incompatibility, when the chromaticity y minimal value is 0.32 or greater, as shown in FIG. 3. That is, from FIG. 3, it is concluded that the evaluation of whether or not the purplish red is conspicuous in the luminescent color of the arc tube at the transient time can not be made at the chromaticity x minimal value, but can be made at the chromaticity y minimal value.

Also, it has been found that there is a correlation of almost inverse proportion between the ratio (wt %) of the charging amount of InI to the total charging amount of metal halides and the chromaticity y minimal value, as shown in FIG. 4.

Moreover, if the ratio (wt %) of the charging amount of InI to the total charging amount of metal halides is adjusted in a range from 0 to 3.0 wt % in the correlation as shown in FIG. 4, the tube voltage of the arc tube is only varied in a range of 45V±about 5V, as shown in FIG. 5. Thereby, it has been found that as light change (3% at maximum) in the ratio of charging amount of InI has no influence on the tube voltage.

FIG. 6 is a view showing the chromaticity x, y of luminescence during the stable discharge of the samples (arc tubes) having a different ratio (wt %) of the charging amount of InI to the total charging amount of metal halides of $ScI_3$, NaI and InI. When the ratio (wt %) of the charging amount of InI to the total charging amount of metal halides is from 0.1 to 2.9 wt %, the chromaticity y falls within the chromaticity standard "ECE R99" range A required as the white light source. However, when the ratio (wt %) of the charging amount of In halide to the total charging amount of metal halides is 0 wt %, the chromaticity y (=0.396) is out of the chromaticity standard "ECE R99" range A and the color of light is greenish. Hence, the ratio (wt %) of the charging amount of In halide to the total charging amount of metal halides to be charged into the closed chamber is desirably 0.1 wt % or more.

SUMMARY OF THE INVENTION

As a result of the above experiment and consideration, it has been confirmed that the ratio of charging amount of InI to the total charging amount of metal halides is adjusted in a range from 0.1 to 2.0 wt % (desirably 0.1 to 0.5 wt %) to avoid the luminescence of purplish red color at the transient time of the arc tube and to allow the luminescent color to fall within the chromaticity standard range required as the white light source during the stable discharge of the arc tube, whereby the invention has been proposed.

This invention has been achieved in the light of the above-mentioned problems associated with the related art and on the basis of the knowledge of the inventor. It is an object of the invention to provide a mercury free arc tube for a discharge lamp in which the luminescence at the transient time does not look like purplish red.

In order to achieve the above object, according to the first aspect of the present invention, there is provided a mercury free arc tube for a discharge lamp, comprising:

a closed chamber filled with rare gas and a metal halide containing at least Na halide, Sc halide and In halide, an internal volume of the closed chamber being 50 μl or less; and electrodes provided in the closed chamber so as to be opposed to each other, wherein a ratio of a filled amount of the In halide in the closed chamber to a total filled amount of metal halide in the closed chamber is ranging from 0.1 to 2.0 wt %.

[Operation]

According to the visible evaluation test of the chromaticity minimal value of luminescence of the arc tube at the transient time, that is for evaluating whether or not the purplish red color is conspicuous by inspecting the luminescence of the arc tube with the naked eye, which was made by the inventor, the purplish red color is conspicuous when the chromaticity y minimal value is less than 0.29, but is not so conspicuous in a range where the chromaticity y minimal value is from 0.29 to 0.32, and not conspicuous at all in other words, with no sense of incompatibility, when the chromaticity y minimal value is 0.32 or greater, shown in FIG. 3.

Moreover, it has been confirmed that there is a correlation between the ratio (wt %) of the charging amount of InI to the total charging amount of metal halides and the chromaticity y minimal value, as shown in FIG. 4.

That is, the evaluation result was that if the ratio (wt %) of the charging amount of In halide to the total charging amount of metal halides is beyond 2.0 wt %, the chromaticity y minimal value of luminescence of the arc tube at the transient time is below 0.29 which is in a state that the luminescent color is strongly purplish red, as shown in FIG. 4. Accordingly, there is a fear that the light of the arc tube is misidentified or confused with the marker lamp such as a stop lamp or tail lamp. If the ratio (wt %) of the charging amount of In halide is in a range from 0.5 to 2.0 wt %, the chromaticity y minimal value of luminescence of the arc tube at the transient time is from 0.29 to 0.32, then the purplish red color is less conspicuous, and especially if the ratio (wt %) of the charging amount of In halide is in a range from 0 to 0.5 wt %, the chromaticity y minimal value of luminescence of the arc tube at the transient time is from 0.32 to 0.34 which is in a state that the purplish red color is not conspicuous at all with no sense of incompatibility.

Accordingly, to avoid the luminescence of the arc tube at the transient time in conspicuous purplish red color, the ratio (wt %) of the charging amount of In halide to the total charging amount of metal halides charged into the closed chamber is from 0 to 2.0 wt %, preferably from 0 to 0.5 wt %.

FIG. 6 is a view showing the chromaticity x, y of luminescence during the stable discharge of the mercury free arc tube having a different ratio (wt %) of the charging amount of In halide to the total charging amount of metal halides. When the ratio (wt %) of the charging amount of In halide to the total charging amount of metal halides is below 0.1 wt %, the luminescent color of the arc tube during the stable discharge is out of the chromaticity standard "ECE R99" range A for the chromaticity y required as the white light source that is, the chromaticity y is greater than the chromaticity standard "ECE R99" range A and the color of light is greenish, as shown in FIG. 6. However, when the ratio (wt %) of the charging amount of In halide is 0.1 wt % or more, the luminescent color of the arc tube during the stable discharge falls within the chromaticity standard range A for the chromaticity y required as the white light source.

Accordingly, in order that the luminescent color of the mercury free arc tube during the stable discharge is the white light having the chromaticity x, y within the chromaticity standard range required as the white light source, it is desirable that the ratio of charging amount of In halide to the total charging amount of metal halides charged into the closed chamber is 0.1 wt % or more.

Consequently, in order that the luminescent color of the arc tube at the transient time is not conspicuous purplish red color, and the luminescent color of the mercury free arc tube during the stable discharge is the white light having the chromaticity x, y within the chromaticity standard "ECE R99" range A required as the white light source, it is desirable that the ratio of charging amount of In halide to the total charging amount of metal halides charged into the closed chamber is from 0.1 to 2.0 wt %, preferably from 0.1 to 0.5 wt %.

Even if the ratio (wt %) of the charging amount of InI to the total charging amount of metal halides is adjusted in a range from 0 to 3.0 wt % in the correlation as shown in FIG. 4, the tube voltage of the arc tube is only varied in a range of 45V±about 5V, as shown in FIG. 5, and is not affected at all. Hence, even with the arc tube having a different ratio (different specification) of the charging amount of InI in a range from 0.1 to 2.0 wt %, the tube voltage characteristics of the arc tube are not changed but the same.

According to a second aspect of the present invention according to the first aspect of the present invention, it is preferable that the metal halide further contains a Zn halide.

[Operation]

Though In halide is effective to increase the tube voltage, the luminescent color at the transient time is purplish red color with the low chromaticity x, y. If the charging amount is large, the ratio of charging amount of In halide is not large, in other words, the tube voltage is not much increased. However, by charging the Zn halide together, which is effective to increase the tube voltage and does not cause abnormal luminescence, which is luminescence of purplish red color, of the arc tube at the transient time, the abnormal luminescence of the arc tube at the transient time is suppressed. Accordingly, the luminescent color during the stable discharge is more suitable by increasing the tube voltage.

According to a third aspect of the present invention as set forth in the first aspect of the present invention, it is more preferable that a ratio of the filled amount of the In halide in the closed chamber to the total filled amount of metal halide in the closed chamber is ranging from 0.1 to 0.5 wt %.

According to a fourth aspect of the present invention as set forth in the first aspect of the present invention, it is further preferable that the metal halide further contains at least one of Tl halide and Zn halide.

According to a fifth aspect of the present invention as set forth in the first aspect of the present invention, it is furthermore preferable that the rare gas in Xe gas.

According to a sixth aspect of the present invention as set forth in the first aspect of the present invention, it is suitable that a halogen in the metal halide is iodine.

According to a seventh aspect of the present invention as set forth in the first aspect of the present invention, it is more preferable that a halogen in the metal halide is bromine.

According to the present invention, the mercury free arc tube for the discharge lamp is provided in which the luminescence of the arc tube is less conspicuous in purplish red color at the transient time from starting the discharge till reaching the stable discharge. Accordingly there are not any fears that the emission of the arc tube is misidentified or confused with the marker lamp such as a stop lamp or tail lamp, in which the luminescent color has the proper chromaticity within the chromaticity standard range required as the white light source during the stable discharge.

According to second aspect of the present invention, the mercury free arc tube for the discharge lamp is provided in which there is no abnormal luminescence, which is luminescence of purplish red color, at the transient time, and the luminescent color with the proper chromaticity during the stable discharge is securely obtained.

BRIEF DESCRIPTION OF THE DRAWINGS

FIG. 3A is a table showing the visible evaluation test results of the chromaticity minimal value of luminescence of the arc tube having a different ratio (wt %) of charging amount of InI at the transient time;

DETAILED DESCRIPTION OF THE PREFERRED EMBODIMENTS

The preferred embodiments of the present invention will be described below.

Figure 1:
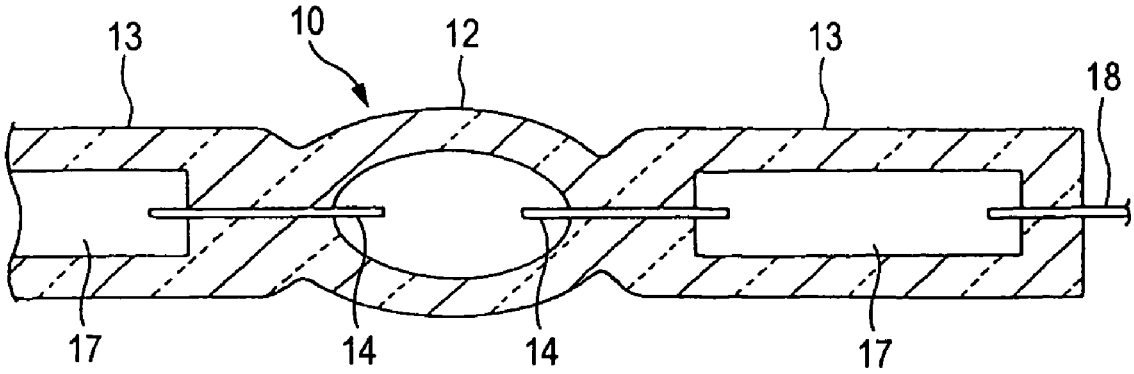
FIG. 1 is a longitudinal cross-sectional view of the essence of a mercury free arc tube for a discharge lamp according to a first embodiment of the present invention.
Figure 2A:
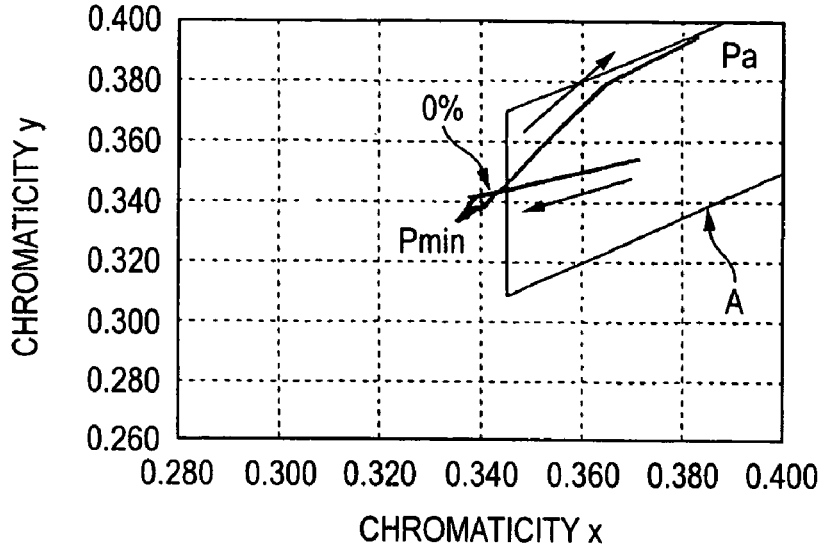
FIG. 2A is a graph showing a chromaticity characteristic curve of luminescence of the arc tube in which the ratio of charging amount of InI is 0.1 wt %.
Figure 2B:
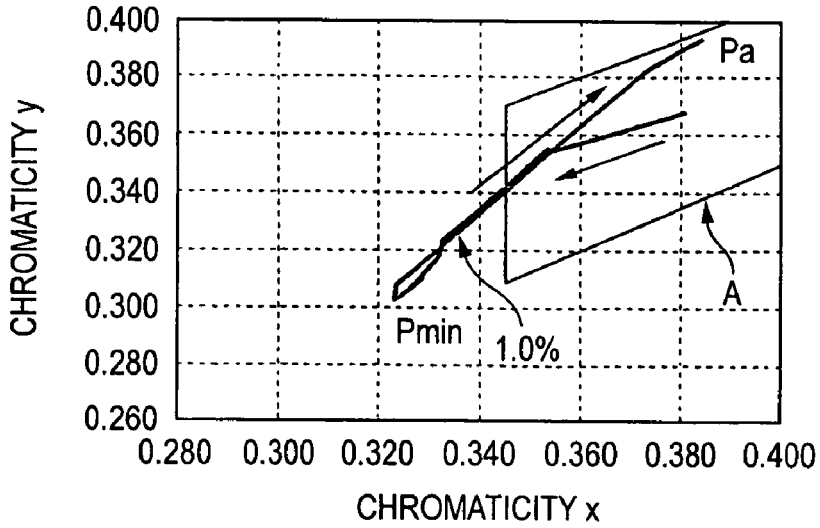
FIG. 2B is a graph showing a chromaticity characteristic curve of luminescence of the arc tube in which the ratio of charging amount of InI is 1.0 wt %.
Figure 2C:
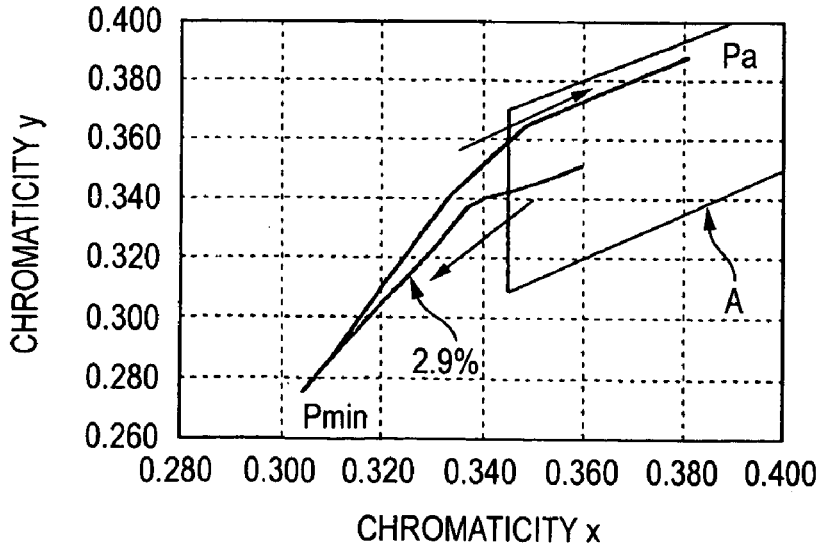
FIG. 2C is a graph showing a chromaticity characteristic curve of luminescence of the arc tube in which the ratio of charging amount of InI is 2.9 wt %.
Figure 3B:
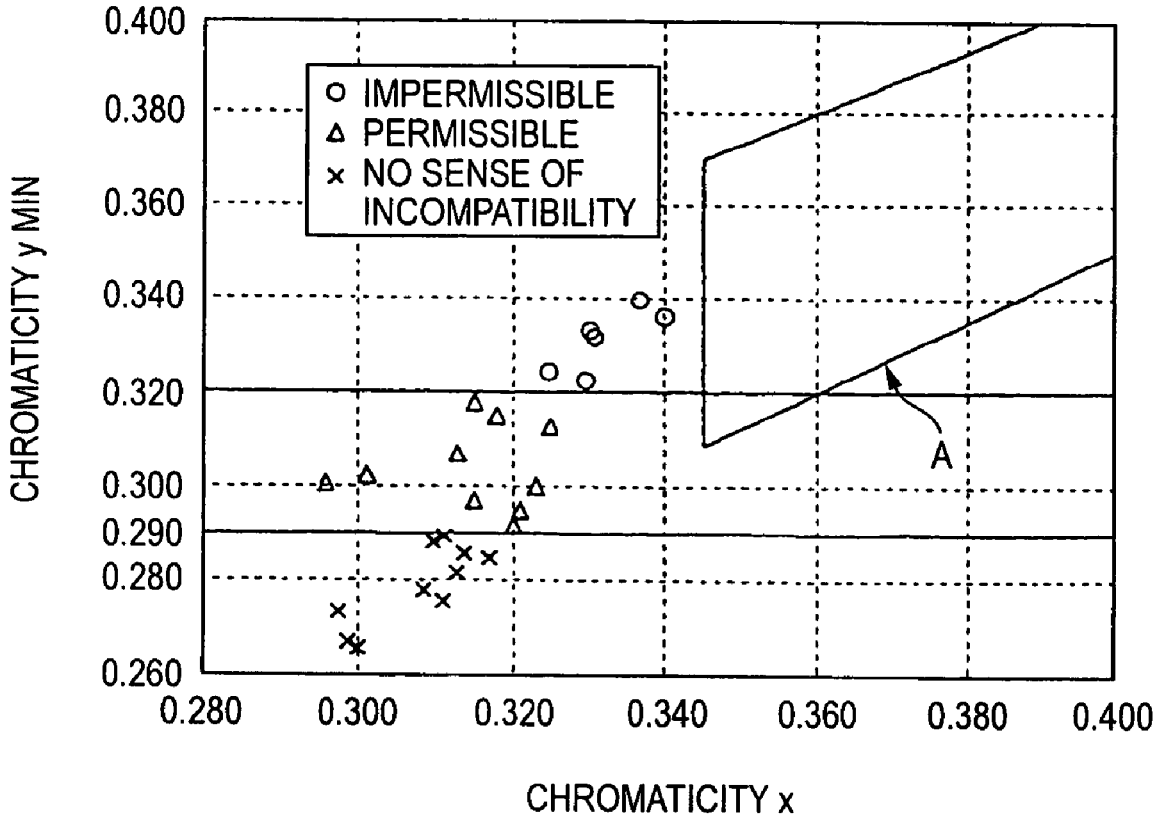
FIG. 3B is a graph showing the visible evaluation test results of the chromaticity minimal value of luminescence of the arc tube having a different ratio (wt %) of charging amount of InI at the transient time.
Figure 4:
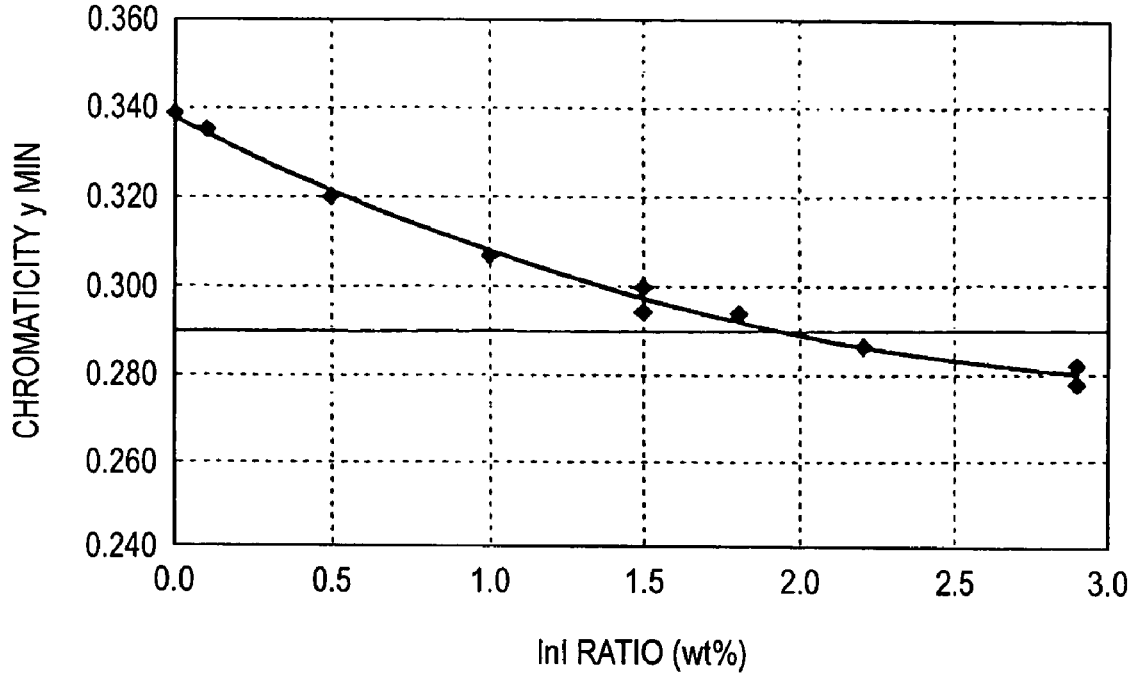
FIG. 4 is a graph showing the correlation between the ratio (wt %) of charging amount of InI and the chromaticity y minimal value.
Figure 5:
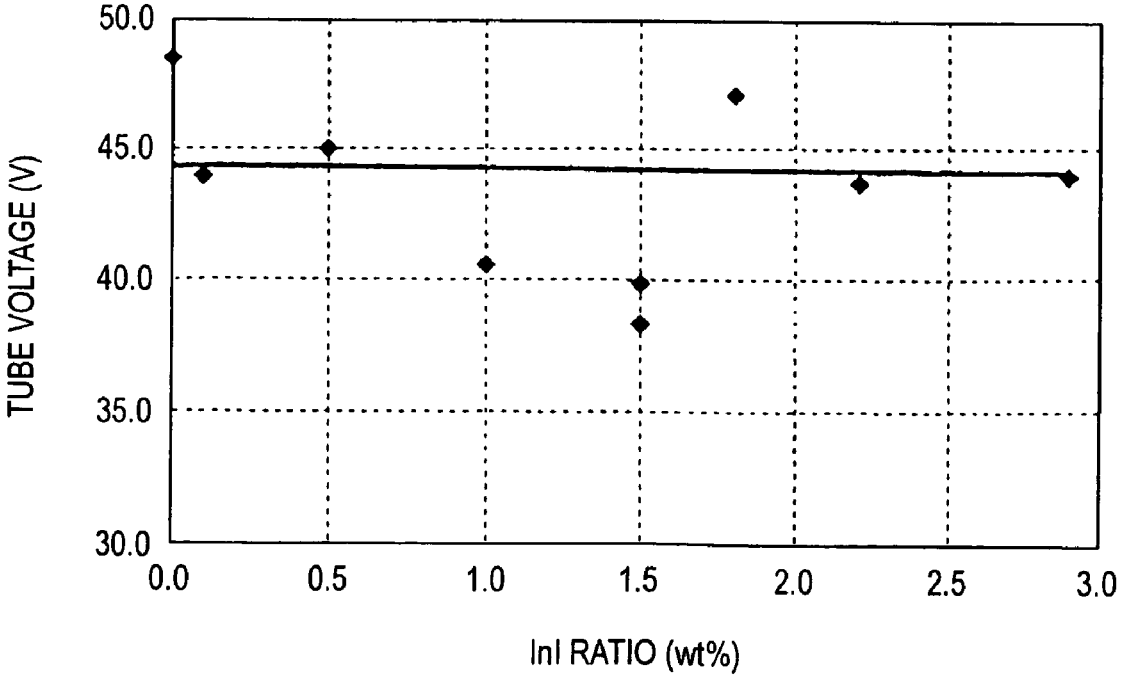
FIG. 5 is a graph showing the relationship between the ratio (wt %) of charging amount of InI and the tube voltage.
Figures 6A, 6B:
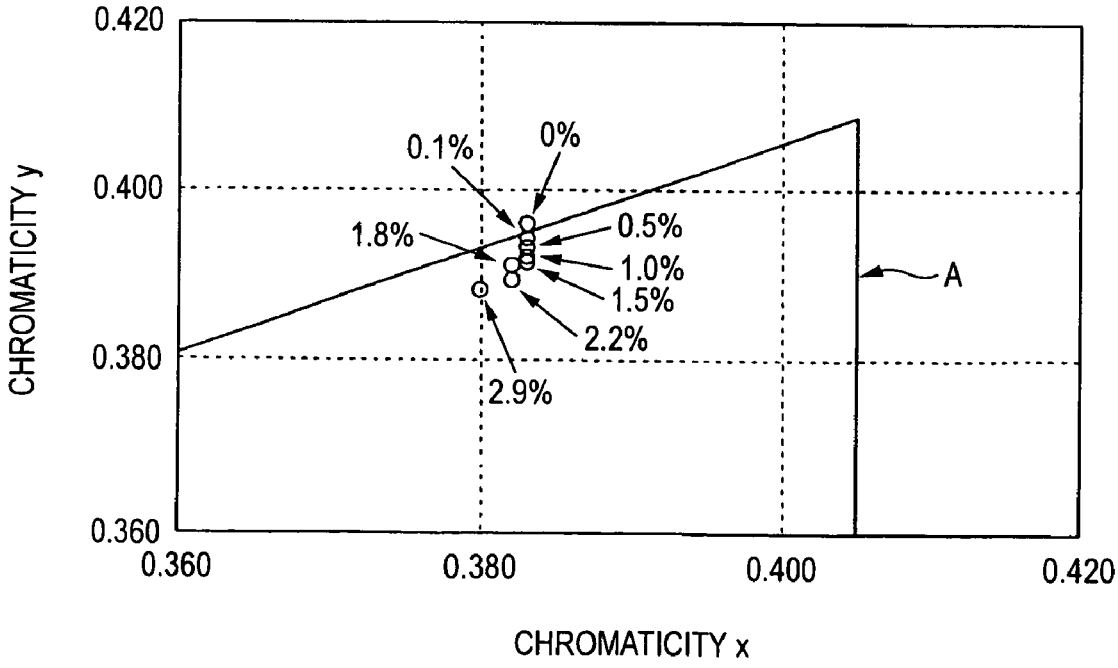
FIG. 6A is a table showing the relationship between the ratio (wt %) of charging amount of InI to the total charging amount of metal halide and the chromaticity of luminescence of the arc tube during the stable discharge.
FIG. 6B is a graph showing the relationship between the ratio (wt %) of charging amount of InI to the total charging amount of metal halide and the chromaticity of luminescence of the arc tube during the stable discharge.

FIGS. 1 to 6 show a mercury free arc tube made of silica glass according to a first embodiment of the invention. FIG. 1 is a longitudinal cross-sectional view of the mercury free arc tube made of silica glass for a discharge lamp according to the first embodiment of the invention. FIG. 2 is a graph showing a chromaticity characteristic curve of luminescence of the arc tube at the transient time, in which FIGS. 2A, 2B and 2C show the chromaticity characteristic curves of luminescence of the arc tube in the cases where the ratio of charging amount of InI is 0.1 wt %, 1.0 wt % and 2.9 wt %. FIG. 3 is a view showing the visible evaluation test results of the chromaticity minimal value of luminescence of the arc tube having a different ratio (wt %) of charging amount of InI at the transient time. FIG. 4 is a graph showing the correlation between the ratio (wt %) of charging amount of InI and the chromaticity y minimal value. FIG. 5 is a graph showing the relationship between the ratio (wt %) of charging amount of InI and the tube voltage. FIG. 6 is a view showing the relationship between the ratio (wt %) of charging amount of InI to the total charging amount of metal halides and the chromaticity of luminescence of the arc tube during the stable discharge.

Figure 8:
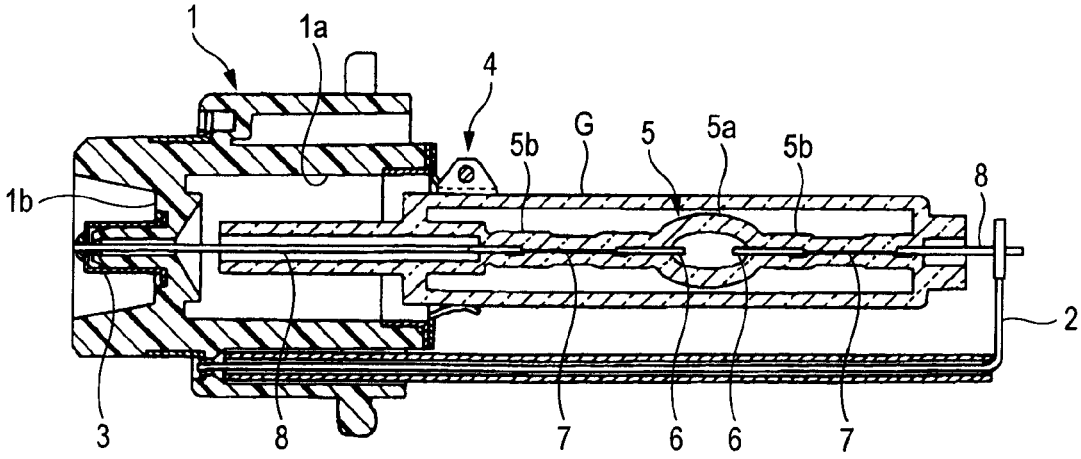
FIG. 8 PRIOR ART
FIG. 8 is a longitudinal cross-sectional view of a conventional discharge lamp.

In FIG. 1, the discharge lamp with the arc tube 10 has the same overall structure as the conventional device of FIG. 8, except for the constitution of the arc tube 10, and is not described here.

The arc tube 10 has a very compact structure in which a silica glass tube in the shape of a circular pipe is formed with a spherical bulging portion on the way of a linear extension portion in a longitudinal direction thereof, apart of the glass tube closer to the spherical bulging portion being pinched and sealed, thereby forming the pinch seal portions 13, 13 of rectangular shape in cross section at both end portions of a tip-less closed glass globe 12 of elliptical or cylindrical shape forming a discharge space, as shown in FIG. 1. Within the closed glass globe 12 that is the closed chamber, the electrodes 14, 14 are opposed, and metal halides are charged together with a starting rare gas. The electrodes 14, 14 are connected to the molybdenum foils 17 sealed together with the pinch seal portions 13, 13, and the molybdenum lead wires 18, 18 connected to the molybdenum foils 17, 17 are led out of the end portions of the pinch seal portions 13, 13.

The content volume of the closed glass globe 12 is 50 μl or less, and the distance between electrodes is from 3.5 to 4.5 mm. Within the closed glass globe 12, in addition to metal halides NaI, $ScI_3$ and InI, at least one of TlI and $ZnI_2$ is charged, as needed, together with Xe gas as the starting rare gas. Each of Na, Sc and Xe acts as the luminous substance, and each of In, Tl and Zn acts as the chromaticity adjustment substance for changing the chromaticity y by charging it by an appropriate amount.

Since the ratio (wt %) of charging amount of InI to the total charging amount of metal halides within the closed glass globe is from 0.1 to 2.0 wt %, preferably from 0.1 to 0.5 wt %, the emission of the arc tube is less conspicuous in purplish red color at the transient time from starting the discharge till reaching the stable discharge, without fear that the emission of the arc tube is misidentified or confused with lighting of the marker lamp such as a stop lamp or a tail lamp, and the luminescent color having a proper chromaticity within the chromaticity standard range required as the white light source is attained during the stable discharge.

That is, FIG. 6 is a view showing the chromaticity x, y of luminescence of the sample (arc tube) having a different ratio (wt %) of charging amount of InI to the total charging amount of metal halides within the closed glass globe during the stable discharge. When the ratio (wt %) of charging amount. of InI to the total charging amount of metal halides is 0.1%, 0.5%, 1.0%, 1.5%, 1.8%, 2.2% and 2.9%, the chromaticity y of luminescence of the arc tube during the stable discharge falls within the chromaticity standard "ECE R99" range A required as the white light source. However, when the ratio of charging amount of In halide to the total charging amount of metal halides is 0%, the chromaticity y (=0.396) is out of the chromaticity standard "ECE R99" range A to cause a greenish light.

Accordingly, the ratio of charging amount of In halide to the total charging amount of metal halides to be charged into the closed chamber is 0.1 wt % or more, whereby the arc tube produces the luminescent color of proper chromaticity within the chromaticity standard range required as the white light source during the stable discharge.

FIG. 3 shows the results of the visible evaluation test for the chromaticity minimal value of luminescence of the arc tube at the transient time for the arc tube having a different ratio (wt %) of charging amount of InI to the total charging amount of metal halides within the closed glass globe. The purplish red color, which is conspicuous when the chromaticity y minimal value is less than 0.29, is not so conspicuous in a range where the chromaticity y minimal value is from 0.29 to 0.32, and no conspicuous at all (no sense of incompatibility), when the chromaticity y minimal value is 0.32 or greater.

FIG. 4 shows the relationship between the ratio (wt %) of charging amount of InI to the total charging amount of metal halides and the chromaticity y minimal value, in which there is a correlation of almost inverse proportion between both.

Therefore, if the ratio of charging amount of In halide to the total charging amount of metal halides is more than 2.0 wt %, the chromaticity y minimal value of luminescence of the arc tube at the transient time is less than 0.29, which is in a state that (the luminescent color is strongly purplish red, as shown in FIG. 4, causing a fear that the emission is misidentified or confused with the marker lamp such as a stop lamp or a tail lamp. However, if the ratio of charging amount of In halide is in a range from 0 to 2.0 wt %, the chromaticity y minimal value of luminescence of the arc tube at the transient time is from 0.29 to 0.32 which is in a state that the purplish red is less conspicuous, and especially in a range where the ratio of charging amount of In halide is from 0 to 0.5 wt %, the chromaticity y minimal value of luminescence of the arc tube at the transient time is from 0.32 to 0.34 which is in a state that the purplish red is not conspicuous at all with no sense of incompatibility.

Accordingly, the ratio of charging amount of In halide to the total charging amount of metal halides to be charged into the closed chamber is made from 0.1 to 2.0 wt %, preferably from 0.1 to 0.5 wt %, whereby there is no conventional problem that the emission of the arc tube is misidentified or confused with the red marker lamp at the transient time, and the white light with proper chromaticity is obtained during the stable discharge.

Also, if the ratio of charging amount of InI to the total charging amount of metal halides is adjusted in a range from 0 to 2.9 wt % in the correlation as shown in FIG. 4, the tube voltage of the arc tube is only varied in a range of 45V±about 5V, as shown in FIG. 5, and not affected, whereby the tube voltage characteristic of the arc tube is not changed and constant even if the arc tube has different specifications in the range where the ratio of charging amount of InI is from 0 to 2.9 wt %.

Accordingly, even if the arc tube is constructed at a different ratio of charging amount of InI to the total charging amount of metal halides in the range from 0.1 to 2.9 wt %, the tube voltage is not varied for each arc tube having different ratio of charging amount of InI, whereby a plurality of kinds of mercury free arc tube for the discharge lamp having different luminescent colors with the positively different ratio of charging amount of InI can be provided to deal with the needs of the user.

The specific examples of the first embodiment of the invention will be described below.

FIRST EXAMPLE

The content volume of the closed glass globe 12 is 18 μl, the outer diameter of the top end portion of electrode is 0.35 mm, metal halides charged into the closed glass globe 12 are NaI, $ScI_3$, InI and TlI, and the starting rare gas is Xe gas.

The ratio of charging amount of InI to the total charging amount of metal halides (NaI, $ScI_3$, InI, TlI) is 1.8 wt %, and the chromaticity y minimal value is 0.294, as shown in FIGS. 3 and 4. Thereby, purplish red color is not so conspicuous in the luminescence of the arc tube at the transient time.

Also, the chromaticity of luminescence of the arc tube during the stable discharge, which is chromaticity x=0.382 and chromaticity y=0.391, falls within the chromaticity standard "ECE R99" range A of the white light source, as shown in FIG. 6. Hence, the proper white color is presented.

SECOND EXAMPLE

The content volume of the closed glass globe 12 is 20 μl, the outer diameter of the top end portion of electrode is 0.35 mm, metal halides charged into the closed glass globe 12 are NaI, $ScI_3$, InI and $ZnI_2$, and the starting rare gas is Xe gas.

The ratio of charging amount of InI to the total charging amount of metal halides (NaI, $ScI_3$, InI, $ZnI_2$) is 1.5 wt %, and the chromaticity y minimal value is 0.294, as shown in FIGS. 3 and 4. Thereby, purplish red color is not so conspicuous in the luminescence of the arc tube at the transient time.

Also, the chromaticity of luminescence of the arc tube during the stable discharge, which is chromaticity x=0.383 and chromaticity y=0.391, falls within the chromaticity standard "ECE R99" range A of the white light source, as shown in FIG. 6. Hence, the proper white color is presented.

Also, in this example, $ZnI_2$, in addition to InI, is charged into the closed glass globe 12, so that a higher tube voltage than in the first example is obtained. That is, InI is effective to increase the tube voltage. However, if its charging amount is large, the luminescence at the transient time has the color of purplish red with low values of chromaticity x, y. Whereby the ratio of charging amount of InI can not be set beyond 3 wt %, there is a limitation on increasing the tube voltage. By charging $ZnI_2$ not leading to abnormal luminescence, which is that the luminescence of purplish red, that is effective to increase the tube voltage (e.g., in the amount of 15 wt % to the total charging amount of metal halides), in addition to InI, the abnormal luminescence of the arc tube at the transient time is suppressed, and the proper luminescent color during the stable discharge is kept due to increased tube voltage.

THIRD, FOURTH, FIFTH AND SIXTH EXAMPLES

The content volume of the closed glass globe 12 is 20 μl, the outer diameter of the top end portion of electrode is 0.35 mm, metal halides charged into the closed glass globe 12 are NaI, $ScI_3$, InI and TlI, and the starting rare gas is Xe gas. The above constitution is common in the third, fourth, fifth and sixth examples.

Also, the ratio of charging amount of InI to the total charging amount of metal halides (NaI, $ScI_3$, InI, TlI) is 1.5 wt % in the third example, 1.0 wt % in the fourth example, 0.5 wt % in the fifth example, and 0.1 wt % in the sixth example. The chromaticity y minimal value is 0.300 in the third example, 0.307 in the fourth example, 0.320 in the fifth example, and 0.335 in the sixth example. Hence, purplish red color is not so conspicuous in the luminescence of the arc tube at the transient time in the third and fourth examples, and purplish red color is not conspicuous at all in the luminescence of the arc tube at the transient time in the fifth and sixth examples which means no sense of incompatibility.

Also, the chromaticity of luminescence of the arc tube during the stable discharge is chromaticity x=0.383, chromaticity y=0.391 in the third example (InI=1.5 wt %), chromaticity x=0.383, chromaticity y=0.392 in the fourth example (InI=1.0 wt %), chromaticity x=0.383, chromaticity y=0.393 in the fifth example (InI=0.5 wt %), and chromaticity x=0.383, chromaticity y=0.394 in the sixth example (InI=0.1 wt %), each of which falls within the chromaticity standard "ECE R99" range A of the white light source, as shown in FIG. 6. Hence, the proper white color is presented.

Figure 7:
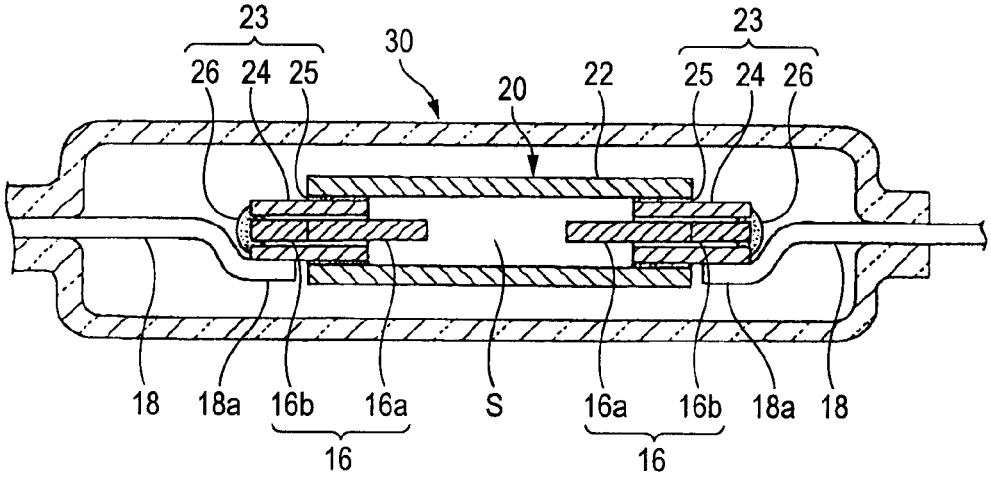
FIG. 7 is a longitudinal cross-sectional view of the essence of a mercury free arc tube for a discharge lamp according to a second embodiment of the present invention.

FIG. 7 shows a second embodiment of the invention that is applied to an arc tube made of ceramics, and is a longitudinal cross-sectional view of the essence of the arc tube made of ceramics for a discharge lamp according to the second embodiment of the invention.

A lead wire 18 electrically connected to an electrode 16 projecting into a closed space S as closed chamber is led out of the front and rear end of the arc tube 20, a shroud glass 30 for shielding ultraviolet rays is sealed (hermetically) to the lead wire 18, whereby both the arc tube 20 and the shroud glass 30 are integrated.

The arc tube 20 is a mercury free arc tube in which both end portions of a translucent ceramics tube 22 having the shape of a right circular cylinder are sealed, the electrodes 16, 16 are opposed in the closed space S within the ceramics tube 22, and metal halides (NaI, $ScI_3$, InI, TlI, etc.) that are luminous substances together with a starting rare gas are charged, whereby the lead wire 18 is joined at the sealed portion before and after the ceramics tube 22 to extend coaxially.

Reference numeral 24 denotes a molybdenum pipe for sealing an opening portion at either end of the arc tube 20 (ceramics tube 22) and securely holding the electrode 16, and symbol 25 denotes a metallized layer for sealing the opening portion at either end of the ceramics tube 22 by joining the ceramics tube 22 and the molybdenum pipe 25.

The electrode 16 has a tungsten portion **16*a* at the top end and a molybdenum portion 16*b* at the base end that are coaxially joined integrally by welding, and fixed via a molybdenum pipe 24 to the ceramics tube 22 by welding the molybdenum portion 16*b* with the molybdenum tube 24. Reference numeral 26 denotes a laser welding portion. And a top end bent portion 18*a* of the molybdenum lead wire 18 is fixed by welding to the molybdenum pipe 24 projecting at the front and rear end of the ceramics tube 22, so that the lead wire 18 and the electrode 16** are arranged on the same line.

That is, the molybdenum pipe 24 is securely joined by metallization at either end of the ceramics tube 22, and the molybdenum portion **16*b* of the electrode 16 is welded to the pipe 24 to constitute the sealing portions 23 of the ceramics tube 22. Accordingly, the sealing portion 23 of the ceramics tube 22 refers to an end portion of the ceramics tube 22 sealed via the molybdenum pipe 24, and more particularly to the molybdenum pipe 24, a laser welding portion 26 and a metallized layer 25**.

The ceramics tube 22 has an outer diameter of 2.0 to 4.0 mm and a length of 8.0 to 12.0 mm, and the content volume of the closed space S sandwiched between the sealing portions 23, 23 is 50 μl or less, very compact to keep the heat resistance and durability. Accordingly, the overall arc tube 20 (luminous tube 22) is luminous almost uniformly.

Also, in addition to metal halides NaI, $ScI_3$ and InI, at least one of TlI and $ZnI_2$ is charged, as needed, together with the starting rare gas Xe gas, into the closed space S, like the first embodiment (first to sixth examples).

Moreover, the ratio of charging amount of InI to the total charging amount of metal halides within the closed space S is from 0.1 to 2.0 wt %, preferably from 0.1 to 0.5 wt %. Therefore, purplish red is less conspicuous in the luminescence of the arc tube at the transient time from starting the discharge till reaching the stable discharge. Accordingly, there is no fear that it is misidentified or confused with lighting of the marker lamp such as a stop lamp or a tail lamp, and the luminescent color with proper chromaticity within a chromaticity standard range required as the white light source is obtained during the stable discharge.

Though in the above examples metal iodide is employed as a metal halide, other metal halides such as metallic bromide may be employed.

While there has been described in connection with the preferred embodiments of the present invention, it will be obvious to those skilled in the art that various changes and modification may be made therein without departing from the present invention, and it is aimed, therefore, to cover in the appended claim all such changes and modifications as fall within the true spirit and scope of the present invention.

What is claims is:

1. A mercury free arc tube for a discharge lamp, comprising:

a closed chamber filled with rare gas and metal halide containing at least Na halide, Sc halide and In halide, an internal volume of the closed chamber being 50 μl or less; and electrodes provided in the closed chamber so as to be opposed to each other, wherein a ratio of a filled amount of the In halide in the closed chamber to a total filled amount of metal halide in the closed chamber is ranging from 0.1 to 1.0 wt %.

2. A mercury free arc tube for a discharge lamp as set forth in claim 1, wherein the metal halide further contains a Zn halide.

3. A mercury free arc tube for a discharge lamp as set forth in claim 1, wherein a ratio of the filled amount of the In halide in the closed chamber to the total filled amount of metal halide in the closed chamber is ranging from 0.1 to 0.5 wt %.

4. A mercury free arc tube for a discharge lamp as set forth in claim 1, wherein the metal halide further contains at least one of Tl halide and Zn halide.

5. A mercury free arc tube for a discharge lamp as set forth in claim 1, wherein the rare gas in Xe gas.

6. A mercury free arc tube for a discharge lamp as set forth in claim 1, wherein a halogen in the metal halide is iodine.

7. A mercury free arc tube for a discharge lamp as set forth in claim 1, wherein a halogen in the metal halide is bromine.

8. A mercury free arc tube for a discharge lamp as set forth in claim 1, wherein the In halide is InI.

9. A headlamp for a vehicle, comprising the mercury free arc tube for a discharge lamp as set forth in claim 1.

* * * * *